US007717614B2

(12) United States Patent
Miller

(10) Patent No.: US 7,717,614 B2
(45) Date of Patent: May 18, 2010

(54) CLAMP SYSTEM FOR FLUID MIXER WITH PIVOTING UPPER PLATE FOR DETECTING CONTAINER TOP

(75) Inventor: William A. Miller, Buffalo Grove, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 987 days.

(21) Appl. No.: 11/371,525

(22) Filed: Mar. 9, 2006

(65) Prior Publication Data

US 2007/0211567 A1 Sep. 13, 2007

(51) Int. Cl.
*B01F 11/00* (2006.01)

(52) U.S. Cl. ..... 366/209; 366/605; 100/228

(58) Field of Classification Search ..... 366/208, 366/209, 211, 605; 100/228
See application file for complete search history.

(56) References Cited

U.S. PATENT DOCUMENTS

| | | | | |
|---|---|---|---|---|
| 142,718 | A * | 9/1873 | Nelson | 100/228 |
| 4,134,689 | A * | 1/1979 | Ahrenskou-Sorensen | 366/110 |
| 4,842,415 | A * | 6/1989 | Cane et al. | 366/110 |
| 5,899,445 | A * | 5/1999 | Kimble | 269/21 |
| 2004/0008573 | A1 * | 1/2004 | MacDonald et al. | 366/209 |
| 2004/0013031 | A1 * | 1/2004 | Salas et al. | 366/141 |

FOREIGN PATENT DOCUMENTS

| | | |
|---|---|---|
| EP | 0 317 112 | 5/1989 |
| WO | WO 02/04108 | 1/2002 |
| WO | WO 03/028873 | 1/2003 |

OTHER PUBLICATIONS

International Searching Authority, "International Search Report and Written Opinion", Jul. 17, 2007, 12 Pages.

* cited by examiner

*Primary Examiner*—David L Sorkin
(74) *Attorney, Agent, or Firm*—Miller Matthias & Hull

(57) ABSTRACT

A clamping mechanism and method are disclosed for a mixing machine that detects when the upper clamping member engages the tops or lids of the containers loaded into the mixing machine. The disclosed clamping mechanism includes a lower base and an upper plate defining an adjustable clamping distance disposed therebetween. At least one of the lower base and upper plate is moveable to increase or decrease the clamping distance. The upper plate is pivotally connected to a cross member so the upper plate is at least partially pivoted away from the cross member when nothing is clamped between the upper plate and lower base. At least one of the cross member and upper plate is associated with a sensor. The sensor is linked to a controller, which controls the movement of the upper plate or the lower base (or both) for clamping and unclamping articles disposed on the lower base. The sensor is activated and sends a signal to the controller when the upper plate has been pressed against the cross member by a top surface of an article clamped between the upper plate and lower cross member under movement controlled by the controller.

19 Claims, 7 Drawing Sheets

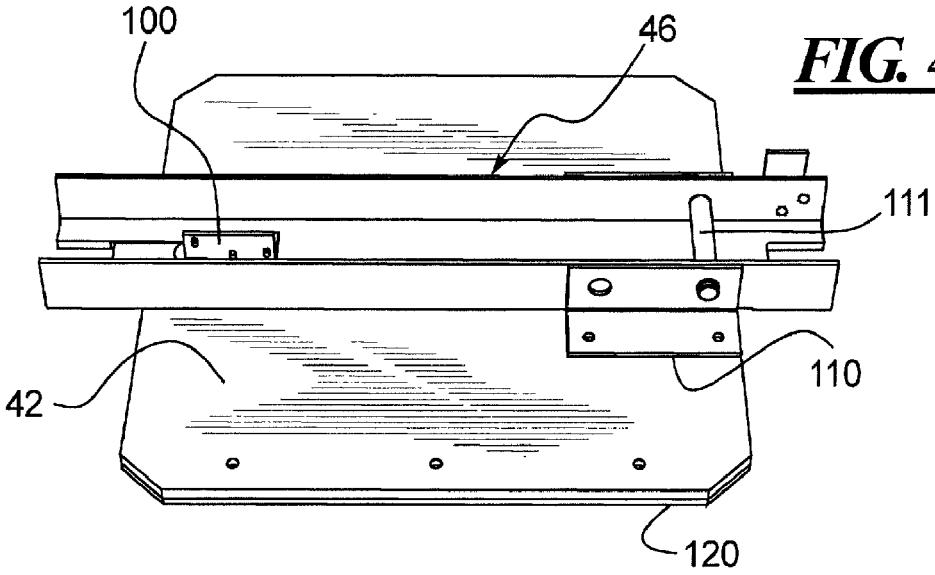
FIG. 4
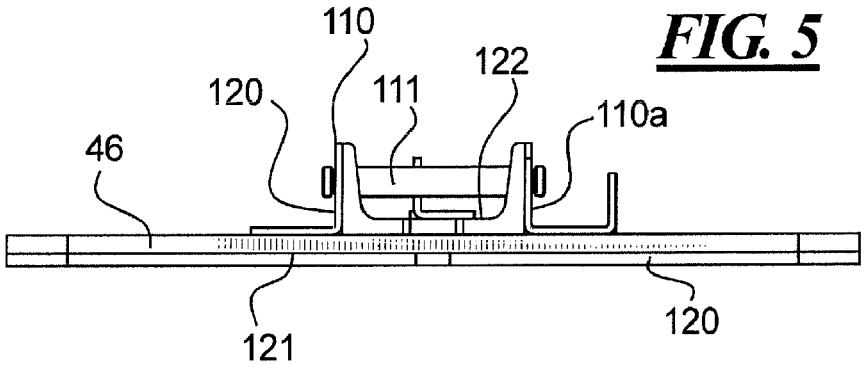
FIG. 5
FIG. 6
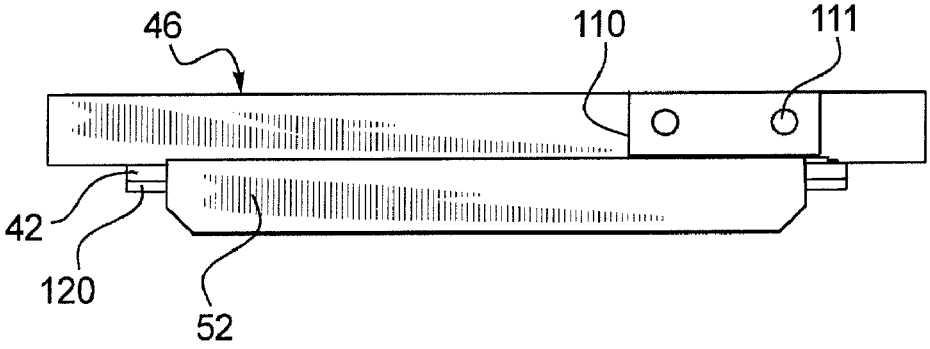

FIG. 7
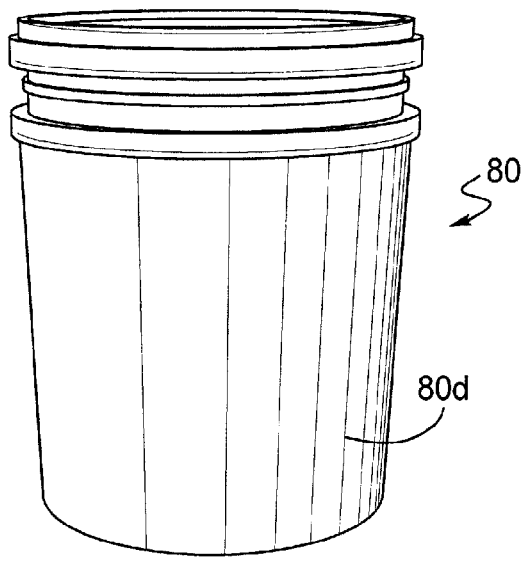
FIG. 8
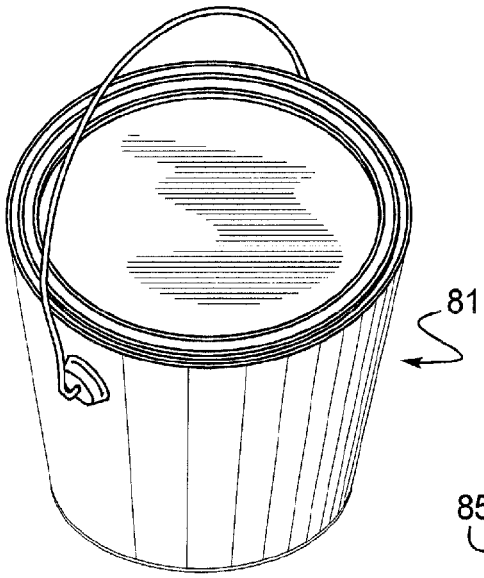
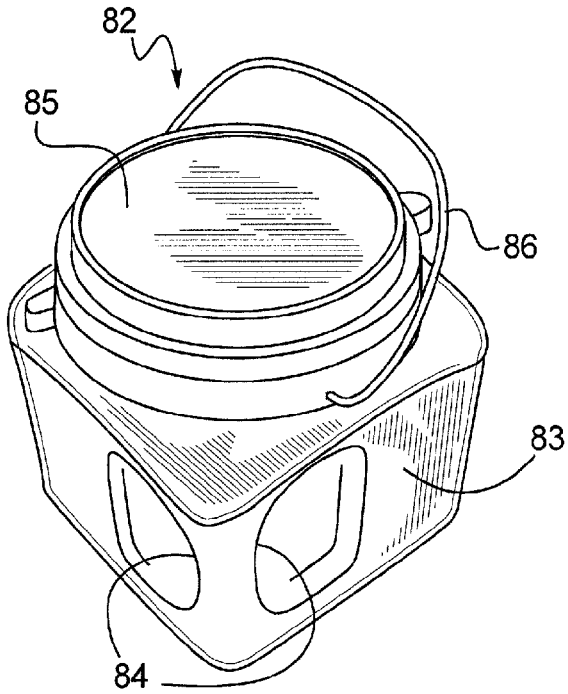
FIG. 9

CLAMP SYSTEM FOR FLUID MIXER WITH PIVOTING UPPER PLATE FOR DETECTING CONTAINER TOP

BACKGROUND

1. Technical Field

An automated clamp system for a fluid mixer is disclosed with an effective means for accurately detecting when the upper clamp plate engages the top of a container placed in the mixer and for communicating the engagement of the upper clamp plate with the container to the controller for use in carrying out a clamping algorithm.

2. Description of the Related Art

Many types of fluids need to be mixed or blended into homogenous mixtures in the same containers in which they are sold to a consumer. One example of such in-container mixing results from colorants or pigments being added to base paints at a retail paint store or paint department of a home improvement store. The mixers or mixing machines may operate by vibration, roto-vibration, gyroscopic motion or rotational motion. The forces exerted on the containers during the mixing process are violent.

To ensure that the container or containers stay in position during the violent mixing operation, various clamping mechanisms have been employed. Until recently, the amount of clamping force imposed on a conventional metal cylindrical container (e.g., 1 gal.) or plastic cylindrical container (e.g., 5 gal.) was not crucial as the containers were extremely rugged, and therefore it is difficult to damage a conventional container by over-clamping.

However, paint has become available in rectangular and cubical plastic containers which are not as robust as the conventional cylindrical containers. Further, there is a need to blend or custom mix colors of paint in the new rectangular containers. One rectangular paint container has a handle molded into one corner for the painter's convenience in pouring paint from the container. Such a rectangular paint container has a rectangular or square footprint or cross section. Another new type of container includes rectangular trays or trough-like buckets sized to receive a paint roller. Some of the rectangular trays or troughs may be pre-equipped with a screen or insert for engaging the roller. Smaller plastic cylindrical containers are also being used instead of the traditional metal cylindrical containers.

The new types of containers are fabricated from plastic and are less robust than the conventional counterparts. Hence, an automatic clamping mechanism of a prior mixing machine is capable of crushing most, if not all, of the new types of containers. To avoid the problem of containers being crushed by the mixing machines and the spillage of paint, new and improved clamping mechanisms and automated clamping mechanisms are needed. Further, such clamping mechanisms must be versatile and capable of use on the various types of containers in the marketplace, both old and new.

In that connection, one key element of any automated clamping system is determining when the upper clamping plate engages the top or lid of the container or containers that has been loaded into the mixer. The initial engagement of the upper plate with the container or containers loaded into the machine is a starting point for many sophisticated clamping algorithms and needs to be communicated accurately to the control circuit or controller. If this information is not accurately detected and communicated, the timing of the clamping algorithm may be off resulting in damage to the container or containers by the over application or under application of clamping force.

SUMMARY OF THE DISCLOSURE

In order to address the problem of applying the correct clamping pressure without crushing or damaging the container, an improved clamping mechanism and a method for detecting when the upper clamping member engages the tops or lids of the containers loaded into a mixing apparatus are disclosed. The clamping mechanism disclosed herein is applicable to other articles and containers in addition to paint containers and other mixing apparatuses in addition to paint, stain or varnish mixers.

A disclosed clamping mechanism comprises a lower base and an upper plate defining an adjustable clamping distance disposed therebetween. At least one of the lower base and upper plate is moveable to increase or decrease the clamping distance. The upper plate is pivotally connected to a cross member so the upper plate is at least partially pivoted away from the cross member when nothing is clamped between the upper plate and lower base. At least one of the cross member and upper plate is associated with a sensor. The sensor is linked to a controller, which controls the movement of the upper plate or the lower base (or both) for clamping and unclamping articles disposed on the lower base. The sensor is activated and sends a signal to the controller when the upper plate has been pressed against the cross member by a top surface of an article clamped between the upper plate and lower cross member under movement controlled by the controller.

In a refinement, the sensor is a Hall effect sensor or a proximity sensor.

In a refinement, the cross member is coupled to a least one drive shaft that is coupled to a motor that is coupled to and controlled by the controller.

In a refinement, the controller carries out a clamping routine that begins with the signal from the sensor that the upper plate has engaged the top of article.

In a refinement, the routine is stored in a memory of the controller.

In a refinement, the memory comprises a plurality of routines, each routine is for a specific type of container for fluid mixtures in need of mixing.

In a refinement, the container is a paint container selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid. Of course, various metric sizes are available as well and adaptable to the disclosed machines.

In a refinement, a plurality of like containers can be placed on the lower base and clamped between the lower base and upper plate.

In a refinement, the like containers have like vertical heights.

In a refinement, the memory includes routines that are dependent upon a number of containers clamped as well as the type of like containers clamped.

A disclosed fluid mixer comprises a controller having a memory with a plurality of clamping routines stored therein for controlling a clamping mechanism. The routines are each designed for a different type of container containing a mixable fluid mixture. The clamping mechanism comprises a lower base and an upper plate that define an adjustable clamping distance disposed therebetween. The upper plate is moveable under direction of the controller to increase or decrease the clamping distance. The upper plate is pivotally connected to a cross member so the upper plate is at least partially pivoted away from the cross member when nothing is clamped between the upper plate and the lower base. At least one of the cross member and upper plate is associated with a sensor. The sensor is linked to the controller. The sensor is activated and sends a signal to the controller when the upper plate has been pressed against the cross member by a top surface of an article clamped between the upper plate and lower base under movement controlled by the controller. The signal received by the controller comprising an input used in a selected routine.

A method is disclosed for clamping one or more containers in place in a fluid mixing apparatus prior to carrying out a mixing operation. The disclosed method comprises placing one or more containers on a lower base, lowering an upper plate pivotally connected to a horizontal cross member towards the container or containers using a motor controlled by a controller, the lower plate is at least partially pivoted away from the cross member before a lower side of the upper plate engages a container to be clamped, sensing when the upper plate engages the one or more containers be sensing when the upper plate pivots into abutting engagement with the cross member and sending a first signal to the controller, reducing the motor speed after the first signal is received by the controller, after the motor speed is reduced, measuring any additional downward movement of the upper plate and measuring any increase in current or voltage drawn by the motor, and if the additional downward movement reaches a first predetermined value, reducing the motor speed again to maintain a holding pressure, or if the current or voltage draw reaches a second predetermined value, adjusting the motor speed to maintain a holding pressure.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 4 is a top perspective view of the upper clamping assembly that includes the upper plate pivotally connected to a u-shaped cross beam that includes a sensor and a retainer as shown in FIGS. 1 through 3B;

FIG. 5 is an end view of the upper clamping assembly shown in FIG. 4;

FIG. 6 is a front plan view of the upper clamping assembly shown in FIG. 4;

FIG. 7 is a front perspective view of a typical five gallon bucket that can be accommodated by the disclosed mixing machine;

FIG. 8 is a top perspective view of a typical one gallon cylindrical metal, plastic or combination plastic/metal container that can be accommodated by the disclosed mixing machine and that can be provided in one and one-half gallon, quart, pint and various metric sizes as well;

FIG. 9 is a top perspective view of a typical square or rectangular plastic container with a built-in handle that can be accommodated by the disclosed mixing machine and that can be provided in a variety of sizes (one gallon, one and one-half gallon, quart, pint, various metric sizes, etc.);

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
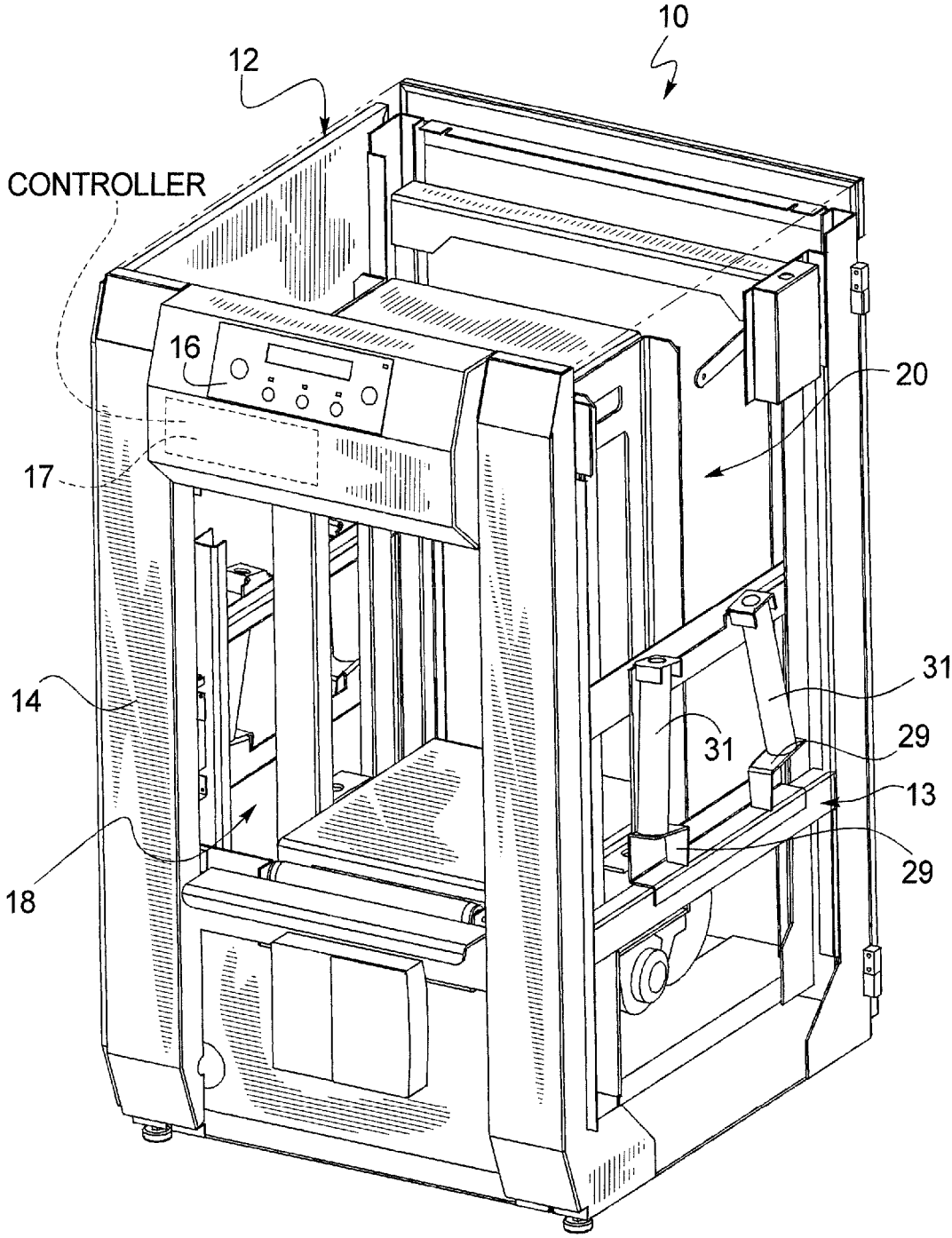
FIG. 1 is a perspective view of a mixing machine made in accordance with this disclosure.

Referring first to FIG. 1, a mixing apparatus 10 is shown having an outer enclosure 12. The outer enclosure 12 includes a front panel 14 having a controls panel 16 in which may be provided input devices (such as switches and knobs) and output devices (such as a timer) for controlling and monitoring operation of the mixer. A controller is shown at 17 for controlling the clamping mechanism 19 shown in FIGS. 2 and 3. The front panel 14 also includes an access window or door 18 through which a user may access an interior of the enclosure 12.

Figure 2:
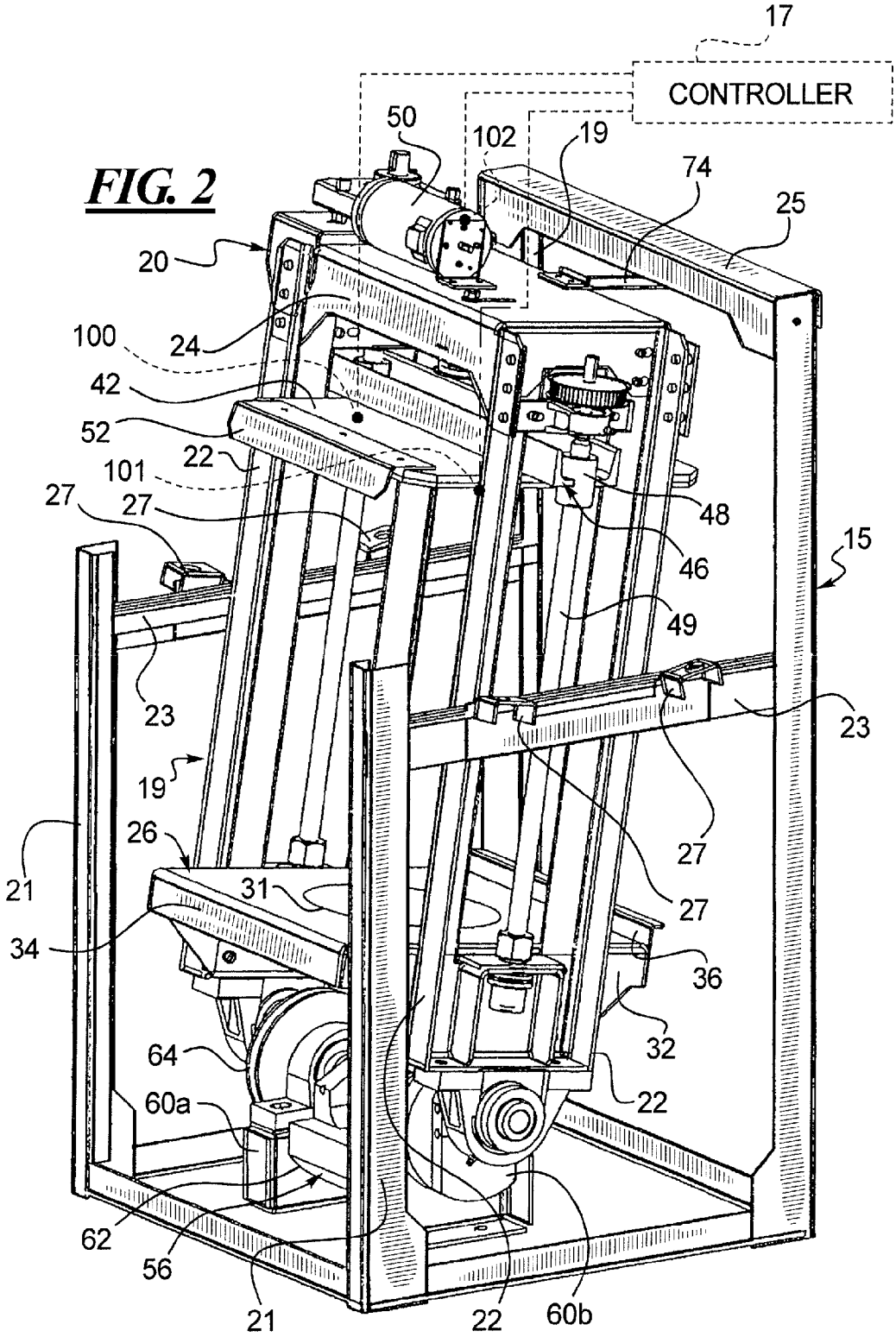
FIG. 2 is a right front perspective view of the internal shaker frame of the shaker-type mixing machine of FIG. 1.

An agitator frame assembly 20 is disposed inside the enclosure 12 for securing a container and for generating a reciprocating force that agitates the container and its contents. As best illustrated in FIG. 2, the agitator frame assembly 20 includes spaced first and second side supports 22, the top ends of which are connected by a cross member 24.

A stationary lower base 26 is attached to and extends between bottom portions of the side supports 22. The lower base assembly 26 also includes two side panels 32, a front wall 34, and a rear wall 36 depending therefrom.

An upper clamping plate 42 is disposed above the lower base 26 and is movable in a vertical direction to adjust the spacing between the lower base 26 and upper plate 42, to thereby accommodate containers of various sizes and to exert the desired clamping force on the container lid. As best shown in FIG. 2, the upper plate 42 includes having a generally rectangular shape and a unshaped cross beam 46 is attached to a top surface of the plate 42. A threaded coupling 48 is attached to each end of the unshaped cross beam 46 and is sized to receive a threaded rod 49. A motor 50 is operably coupled to the threaded rods 49 by way of a pulley mechanism for rotating the rods 49 in either the clockwise or counter-clockwise direction, thereby raising or lowering the upper plate 42 with respect to the lower base 26. The upper plate 42 may also include a front lip 52 attached to the plate 42.

The lower base 26 and upper plate 42 form an adjustable clamp for securely holding containers during operation of the mixer 10. A clamping area or space is defined between the lower base 26 and upper plate 42. Accordingly, a height of the clamping area will vary with the position of the upper clamp member 42 with respect to the clamp base 26, thereby allowing the adjustable clamp to accommodate containers of various heights. In addition, the open frame construction of the agitator frame assembly 20 accommodates various container sizes and shapes.

An eccentric drive 56 is coupled to a bottom of the agitator frame assembly 20 for driving the frame assembly 20 in a reciprocating motion. As illustrated in FIGS. 2 and 3, the eccentric drive 56 includes a drive shaft 58 supported for rotation by two inner bearings 60*a* and a pair of stub shafts 68, 70 supported by outer bearings 60*b*. The bearings 60*a* may be pillow block bearings that are coupled to the stationary outer enclosure 12. A counterweight 62 is coupled to the drive shaft 58. A pulley 64 is attached to one end of the drive shaft 58 adapted to be rotatably driven, such as be a belt coupled to a motor (not shown). A coupling 66 is coupled to the end of the drive shaft 58 opposite the pulley 64. The stub shafts 68, 70 are coupled to the pulley 64 and coupling 66, respectively. The stub shafts 68, 70 are aligned to have substantially the same axis, but are offset from an axis of the drive shaft 58, so that the stub shafts 68, 70 are eccentrically mounted with respect to the drive shaft 58. Outer ends of the stub shafts 68, 70 are rotatably received by the pillow block bearings 60*b*, coupled to the bottom ends of the side supports 22. As a result, rotation of the drive shaft 58 causes the stub shafts 68, 70 to revolve about an axis of the drive shaft 58, thereby driving the frame assembly 20 in a reciprocating motion. The maximum displacement, or stroke, of the eccentric drive is determined by the distance between the drive shaft axis and the stub shaft axis.

The top of the agitator frame assembly 20 is secured to the outer enclosure 12 by a flexible link. For example, a slat 74 may have a first end attached to the cross member 24 (FIG. 2) and a second end coupled to the enclosure 12. The slat 74 may be flexible to act like a leaf spring, thereby to accommodate movement of the frame assembly 20 during operation of the mixer 10. Accordingly, the bottom end of the frame assembly 20 is secured to the enclosure 12 by the bearings 60 which receive the drive axis 58 and the top end of the frame assembly 20 is secured to the enclosure 12 by the slat 74, thereby maintaining the frame assembly 20 in an upright orientation.

A sensor 100 is disposed or associated with the upper plate 42 and/or cross member 46 for detecting when the upper plate 42 makes contact with a top of a container disposed on the lower base 26. A home sensor 101 is used to keep track of the position of the upper plate 42 and the distance traveled by the upper plate 42. Both sensors 101, 102 are linked to the controller 17 or control circuit board.

Figure 3A:
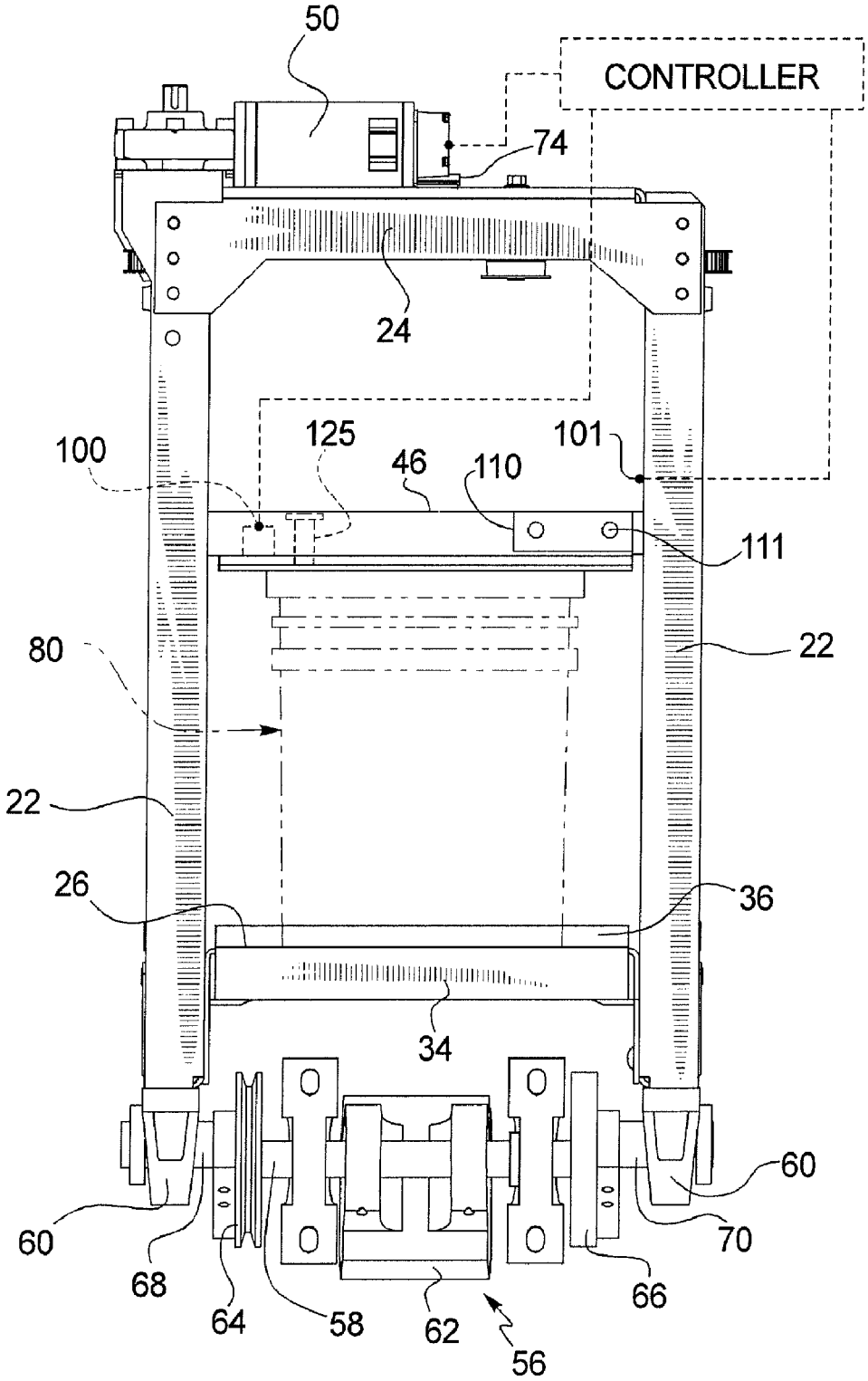
FIG. 3A is a front perspective view of the internal shaker frame of the shaker-type mixing machine of FIGS. 1 and 2, with the front lip of the upper plate removed for clarity and the upper plate shown pivoted upward by way of engagement of the upper plate with a five gallon container that has been loaded into the mixer.
Figure 3B:
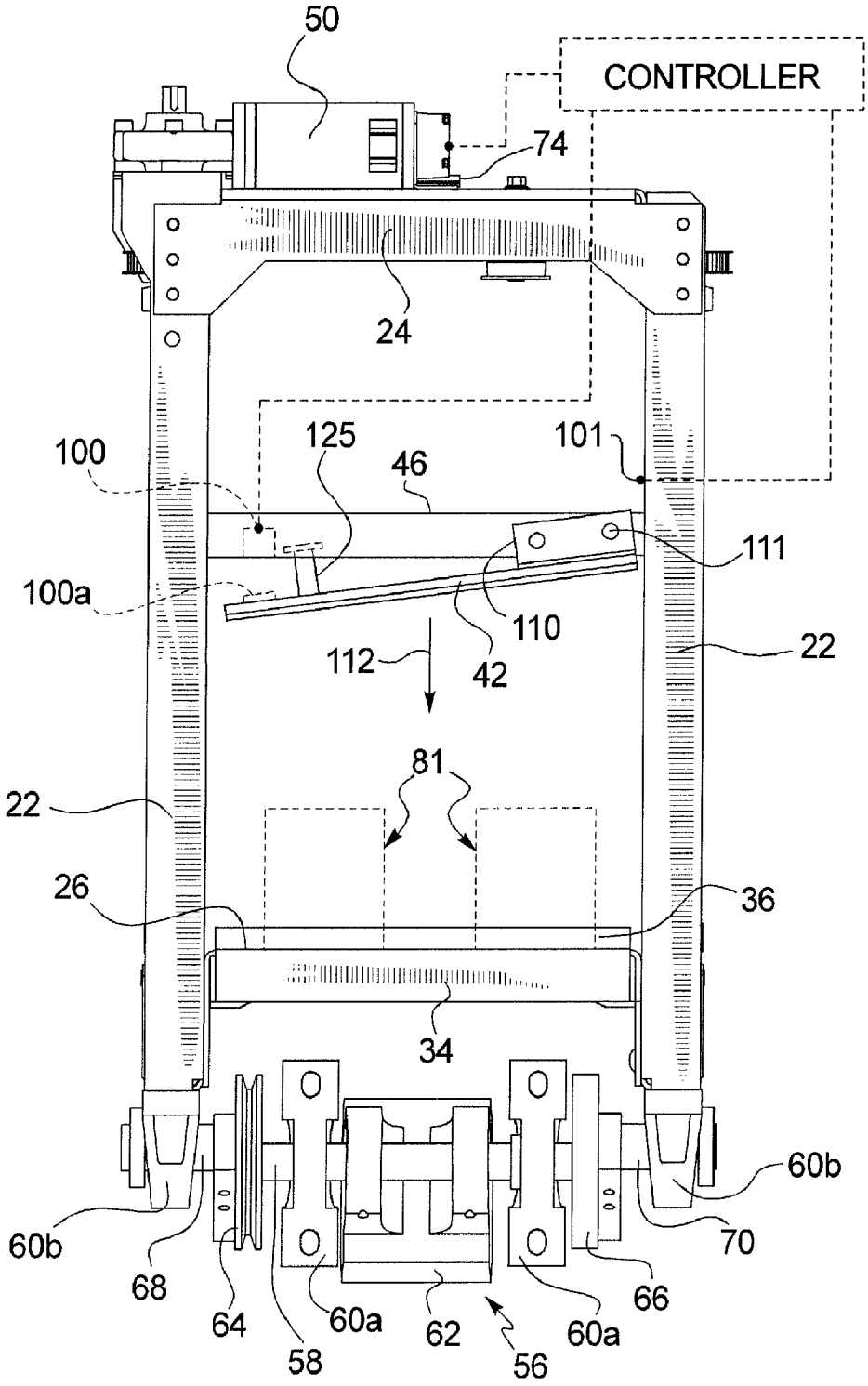
FIG. 3B is another front perspective view of the internal shaker frame of the shaker-type mixing machine of FIGS. 1 and 2, with the front lip of the upper plate removed for clarity and the upper plate pivoted downward prior to engagement of the upper plate with the one gallon containers loaded into the mixer.

As shown in FIGS. 3A-3B, the upper plate 42 is pivotally connected to the cross member 46 by the bracket 110 and pin 111. Thus, as shown in FIG. 3B, the plate 42 is pivoted away from the cross member 46 under the force of gravity when no container or article is being clamped between the upper plate 42 and lower base 26 (compare FIG. 3B with FIG. 3A). As shown in FIG. 3B, as the plate 42 and cross member 46 moves downward towards the containers 81 in the direction of the arrow 112 under the direction of the controller 17, the plate 42 is at least partially pivoted away from the cross member 46. When the plate 42 engages a container, like the one shown at 80 in FIG. 3A, the plate 42 engages the cross member 46 and the sensor 100 is activated by the plate 42 or by way of an additional element 100*a*. The plate 42 may also carry the sensor instead of the cross member 46.

The engagement of the plate 42 with the cross member 46 and the ensuing signal to the controller 17 is an important starting point of many clamping algorithms. As noted below, in the moments after the engagement of the upper plate 42 with the tops of the containers, the controller 17 determines whether the container(s) being clamped is a sturdy conventional container or a less robust new plastic container. The clamping routine or algorithm is selected in these moments and if a delay in the top of container determination occurs, a plastic container can be crushed or damaged in the ensuing moments after the delay.

Details of the upper clamping plate 42 and cross member 46 are shown in FIGS. 4-6. The upper plate 42 is covered by a pad 120 on its underside 121. The pad 121 serves as a cushion and prevents marring or damage to the containers during the mixing process. The cross member 46 is u-shaped and accommodates the sensor 100 in its trough 122. As shown in FIG. 5, the front bracket 110 may be accompanied by a rear bracket 110*a*.

Returning to FIGS. 3A-3B, the upper plate 42 may be equipped with a retainer 125 to limit the downward movement of the upper plate 42 prior to engagement with a container. The hinge mechanism provided by the brackets 110, 110*a* and pin 111 may also include such a movement restriction element.

One problem addressed herein is how to use an automated clamping system for the mixer 10 with the variety of currently available containers shown in FIGS. 7-11. Turning to FIGS. 7-11, five different fluid containers, in particular paint containers, are illustrated which are in current use or will be used in the near future. The containers shown in FIGS. 7-11 are available in a variety of sizes including five gallon, one and one-half gallon, one gallon, one quart, one pint and various metric sizes as well.

FIG. 7 illustrates a five gallon plastic pail 80 that is sturdy or robust enough to withstand clamping forces by currently available mixer designs, such as that shown at 10 in FIGS. 1-3B. The pail 80 may also be fabricated from metal. Because of the sturdiness of this container 80, clamping pressure is not normally an issue. Turning to FIG. 8, a typical metal cylindrical pail 81 is disclosed. The metal walls and top provide a sturdy construction. The typical volume is one gallon. Like the five gallon container 80 shown in FIG. 7, the pail 81 is sturdy and over-lamping or crushing for a conventional clamping apparatus is normally not a problem. The pail 81 may also be fabricated from plastic or a combination of plastic and metal and it is envisioned that these types of containers will be provided in plastic, plastic/metal in combination as well as metal embodiments in the future. The clamping pressure for a plastic embodiment of the pail 81 may need to be less than that for a metal pail 81.

Turning to FIG. 9, a new plastic container 82 is disclosed that has a generally cubical body 83 with a built-in handle shown at 84. The plastic container 82 includes a plastic round top 85 and a bail 86. The container 82, because of its plastic and lightweight construction, is not as strong or robust as the containers shown at 80, 81 in FIGS. 7 and 8, respectively. Therefore, any clamping pressure applied to the container 82 must be substantially less than that applied to the containers 80, 81. Further, because of its plastic construction, the structure of the container 82 can be somewhat compressed by a clamping mechanism. One way to control clamping pressure will be to allow only a certain and limited amount of downward travel of the upper plate 42 after the upper plate 42 engages the top 85 of the container 82. This strategy will be discussed in greater detail below. Other strategies would be to limit the amount of clamping force imposed by the upper plate 42 on the container 82, limiting the current increase experienced by the motor 50 after the upper plate 42 engages the top 85 of the container 82 or simply measuring clamping or holding pressure and limiting the value of the pressure or force imposed on the container 82.

Figure 10:
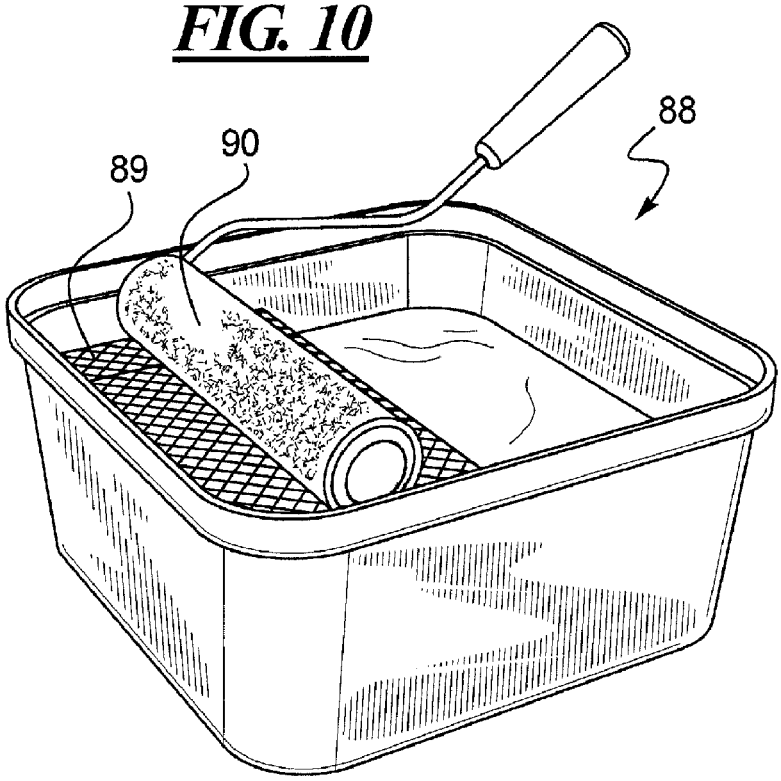
FIG. 10 is a top perspective view of a typical rectangular plastic container equipped to receive a roller that can be accommodated by the disclosed mixing machine and that can be provided in a variety of sizes (one gallon, one and one-half gallon, quart, pint, various metric sizes, etc.)

Similar strategies would need to be employed for the rectangular container 88 shown in FIG. 10 which has a rectangular body with a built-in screen or mesh 89 for receiving a roller shown at 90. The container 88 includes a rectangular top and is typically made of plastic. Hence, the container 88 could be crushed or ruptured if the same force were imposed on the container 88 as that needed to secure a larger container 80 in place. Thus, the container 88, like the container 82 of FIG. 9, requires reduced clamping force. Similarly, the trough-like container 91 of FIG. 11 may also be fabricated from plastic and would therefore require a reduced clamping force.

Figure 11:
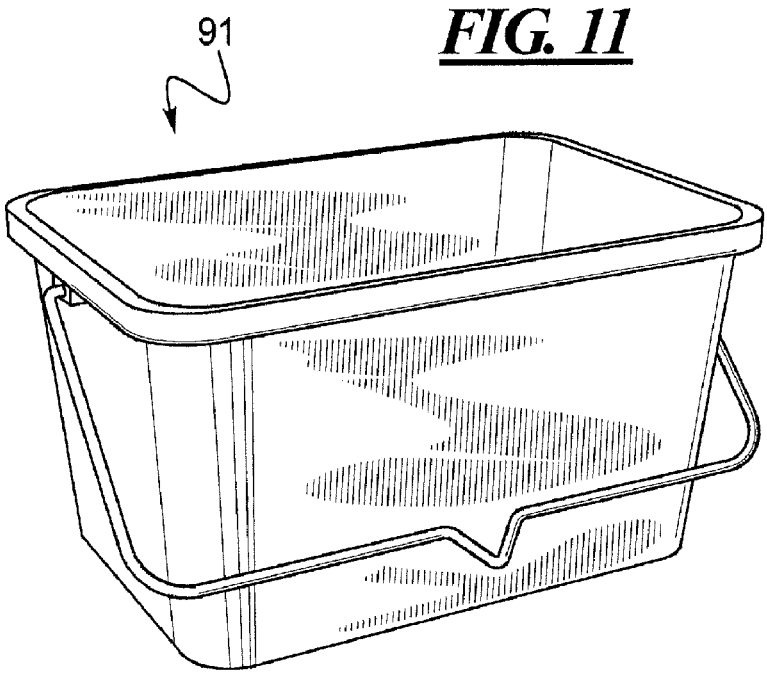
FIG. 11 is a top perspective view of a typical trough-type plastic container that can be accommodated by the disclosed mixing machine and that can be provided in a variety of sizes (one gallon, one and one-half gallon, quart, pint, various metric sizes, etc.).

Thus, paint containers are available in two general types. First, the traditional, metal cylindrical, quart, gallon and five gallon containers are robust in construction and can withstand a high clamping force. These containers are shown at 80 and 81 in FIGS. 7-8. Crushing of these containers is not normally an issue for a mixer that is operating properly. The second broad category includes newer plastic quart, gallon, one and one-half gallon and a variety of containers that can be used with paint rollers. These containers, shown by way of example at 82, 88 and 91 in FIGS. 9-11 are less rigid and can be damaged or caused to leak by a high clamping force required to hold the heavier conventional five gallon plastic bucket or metal cylindrical containers in place.

To avoid crushing a newer plastic container, the disclosed system and method takes advantage of the compressibility of these less rigid plastic containers. It has been found that plastic containers can be compressed without structural damage if the compression amount or compression distance is limited to a predetermined value or range. By way of example only, it has been found that a plastic paint container can be safely clamped in place without structural damage if the clamp plate travel after engagement with the top of the container is limited to a certain value, for example, about 5/16" (~0.3125" or ~7.94 mm). When the compression amount if limited or controlled, the container will not move or will move very little during a three minute violent shake cycle. Also the clamping force causing such a controlled compression of the container would not cause permanent damage or leaks.

Preferably, but not essentially, a predetermined compression distance can be used for all of the current types of plastic containers including cubical with built-in handle 82 (FIG. 9), rectangular trough 88 with built-in screen for use with roller (FIG. 10), rectangular trough-type 91 (FIG. 11) and one gallon plastic cylindrical (see 81 of FIG. 8). The same value can also be used regardless of how many containers were in the clamping mechanism. For example, four of the cubical plastic containers 82 with built-in handles can fit on many mixer platforms. However, one restriction is that multiple containers be of the same height for an accurate compression distance to be measured.

Preferably, the compression distance upper limit is set to about 5/16" or about 0.3125 in. for the currently available plastic containers and anticipated containers, less preferably to about 0.32 in. The value may vary as materials of construction and/or government regulations change. A compression distance range can also be set, for example, from about 0.30 to about 0.32 in.

Of course, some conventional containers 80, 81 are not readily compressible, such a metal cans, drums or the larger (five gal.) plastic buckets or pails. To address the issue of these containers being used with the same machine as the new plastic containers, a second limit on clamping force is needed. In the disclosed system and method, an increase in current or voltage drawn by the clamping motor 50 is monitored after initial contact with the top(s) of the container(s), and if the increase reaches a threshold value, the motion of the upper clamping plate is stopped.

The upper clamping plate 42 may include a downwardly facing lip 52 to prevent forward movement of the clamped containers and the fixed lower base 26 may include an upward facing lip 36 on its rear edge to prevent containers falling out in a rearward fashion. The lead screws 49 are rotated by the motor 50, preferably by a DC motor. The speed (rpm) and direction is controlled by the controller 17 or one or more control circuit boards. A sensor 102 on the motor shaft preferably sends a pulse to the controller every revolution of the motor. By way of example, one revolution of the motor may be equivalent to a fraction of a revolution (e.g., $1/25^{th}$) of the lead screw thereby producing a short movement of the upper clamp plate (e.g., 0394") and enabling accurate monitoring of the upper plate 42 position.

The motor 50 current is measured by the controller 17. Voltage may also be measure or monitored instead of or in addition to motor current. The current is related to the torque exerted by the motor 50 and hence to the pressure exerted by the clamp plates 26, 42 on the container(s).

A home sensor 101 detects the position of the upper plate 42 and acts as a reference which together with the sensor 102 on the motor shaft allows the controller 17 to calculate where the upper plate 42 is at all times.

In operation, the upper plate 42 is raised (if necessary) to load the container(s). The operator will close the door 18, select a mix time and press a start switch. The upper plate 42 will be lowered by the motor 50 at full or high speed. The sensor 100 on the upper clamp plate 42 or cross member 46 will send a signal to the controller 17 when the plate engages the top of the container(s). At this point, the power supplied to the motor 50 will be reduced to slow the motor 50. The timing of the container contact signal to the controller 17 is crucial as a delay or signal failure can result in a plastic paint container or containers being crushed or damages prior to mixing or shaking, which could result in a time consuming clean-up process.

The motor 50 will be operated at reduced power until either of two things happen: (1) the upper plate 42 travels a predetermined distance (compression distance) below the point of contact with the top(s) of the container(s) or (2) the motor current or voltage increases above a predetermined level related to the maximum required clamp pressure of an incompressible (conventional) container. Power supplied to the motor 50 is then further reduced to a holding level sufficient to maintain whatever pressure the clamp is exerting but without driving the upper plate 42 further downward. At this point, the shake motor (not shown) is activated for the duration of the selected mix time. When the mix time has elapsed, the shake motor is switched off and, after a slow down time, the upper clamp plate 42 is raised and the door lock released so the operator can remove the container(s).

Additional refinements may include adjustments to the compression distance and holding current or voltage level depending on the height of the upper plate (i.e. height of the container(s)). Another refinement may include adjusting the holding power according to whether (1) or (2) occurred above.

Thus, disclosed herein is a system and method for adequately securing the currently available paint containers 80, 81, 82, 88, 91 and others in an automated fashion without crushing or damaging the containers, without using any special adapters and without operator intervention.

While only certain embodiments have been set forth, alternatives and modifications will be apparent from the above description to those skilled in the art. These and other alternatives are considered equivalents and within the spirit and scope of this disclosure and the appended claims.

What is claimed:

1. A clamping mechanism comprising:

a lower base and an upper plate defining an adjustable clamping distance disposed therebetween, at least one of the lower base and upper plate being moveable to increase or decrease the clamping distance;

a horizontal cross member pivotally connected to the upper plate so the upper plate least partially pivots downward and away from the horizontal cross member when nothing is clamped between the upper plate and lower base; and a sensor coupled to at least one of the upper plate and the horizontal cross member and being linked to a controller, the controller controlling the movement of said at least one of the upper plate and lower base for clamping and unclamping articles disposed on the lower base, the sensor being activated and sending a signal to the controller when the upper plate has been pivoted upward and pressed against the horizontal cross member by a top surface of an article clamped between the upper plate and lower base under movement controlled by the controller, the signal received by the controller comprising an input used in a selected routine.

2. The clamping mechanism of claim 1 wherein the sensor is a Hall effect sensor or a proximity sensor.

3. The clamping mechanism of claim 1 wherein the cross member is coupled to a least one drive shaft that is coupled to a motor that is coupled to and controlled by the controller.

4. The clamping mechanism of claim 1 wherein the controller carries out a clamping routine that begins with the signal from the sensor that the upper plate has engaged the top of article.

5. The clamping mechanism of claim 4 wherein the routine is stored in a memory of the controller.

6. The clamping mechanism of claim 5 wherein the memory comprises a plurality of routines, each routine being for a specific type of container for fluid mixtures in need of mixing.

7. The clamping mechanism of claim 6 wherein the container is a paint container selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

8. The clamping mechanism of claim 7 wherein a plurality of like containers can be placed on the lower base and clamped between the lower base and upper plate.

9. The clamping mechanism of claim 8 wherein the like containers have like vertical heights.

10. The clamping mechanism of claim 9 wherein the memory includes routines that are dependent upon a number of containers clamped as well as the type of like containers clamped.

11. A fluid mixer comprising:

a clamping mechanism including a lower base and an upper plate defining an adjustable clamping distance disposed therebetween; and a horizontal cross member having the upper plate pivotally connected to the horizontal cross member wherein the upper plate is pivoted downward and away from the cross member when nothing is clamped between the upper plate and lower base;

a controller, the controller having a memory with a plurality of clamping routines stored therein for controlling the clamping mechanism, each routine being for a different type of container containing a mixable fluid mixture, the controller being in electrical communication with the clamping mechanism, the horizontal cross member and upper plate being moveable under direction of the controller to increase or decrease the clamping distance; and a sensor coupled to at least one of the upper plate and the horizontal cross member and being linked to the controller, the sensor being activated and sending a signal to the controller when the upper plate is pressed upward against the horizontal cross member by a top surface of an article clamped between the upper plate and lower base under movement controlled by the controller, the signal received by the controller comprising an input used in a selected routine.

12. The fluid mixer of claim 11 wherein the sensor is one of a Hall effect sensor or a proximity sensor.

13. The fluid mixer of claim 11 wherein the cross member is coupled to a least one drive shaft that is coupled to a motor that is coupled to and controlled by the controller.

14. The fluid mixer of claim 11 wherein the controller carries out the selected clamping routine that begins with the signal from the sensor that the upper plate has engaged the top of article.

15. The fluid mixer of claim 14 further comprising a control panel for inputting the type of container being loaded onto the lower base.

16. The fluid mixer of claim 15 wherein the type of container is a type of paint container selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

17. The fluid mixer of claim 16 wherein a plurality of like containers can be placed on the lower base and clamped between the lower base and upper plate.

18. The fluid mixer of claim 17 wherein the like containers have like vertical heights.

19. The fluid mixer of claim 18 wherein the routines are dependent upon a number of containers arranged on the lower base as well as the type of like containers clamped.

* * * * *